United States Patent [19]

Essex

[11] Patent Number: 5,054,744

[45] Date of Patent: Oct. 8, 1991

[54] PULLING DEVICE FOR REMOVING GROUND EMBEDDED STRUCTURES

[76] Inventor: Jimmie D. Essex, 108 Locust La., Cuba, Ill. 61427

[21] Appl. No.: 398,740

[22] Filed: Aug. 25, 1989

[51] Int. Cl.[5] ..... B66D 11/00

[52] U.S. Cl. ..... 254/228; 254/132

[58] Field of Search ..... 254/385, 386, 199, 120, 254/132, 228

[56] References Cited

U.S. PATENT DOCUMENTS

| | | | |
|---|---|---|---|
| 215,720 | 5/1879 | Chapman | 254/132 |
| 1,553,692 | 9/1925 | Huckle . | |
| 2,634,092 | 4/1953 | Lindquist | 254/132 |
| 2,796,233 | 6/1957 | Stanford | 254/139.1 |
| 2,854,213 | 9/1958 | Hawkins | 254/132 |
| 3,201,085 | 8/1965 | Maley | 254/64 |
| 3,298,663 | 1/1967 | Hextell | 254/83 |
| 3,405,605 | 10/1968 | Ross | 91/173 |
| 3,576,311 | 4/1971 | Carther | 254/132 |
| 3,743,249 | 7/1973 | van Daalen | 254/900 |
| 4,461,187 | 7/1984 | Stanton . | |
| 4,475,716 | 10/1984 | Jarman et al. . | |

FOREIGN PATENT DOCUMENTS

| | | | |
|---|---|---|---|
| 298559 | 7/1932 | Italy | 254/120 |
| 604260 | 5/1960 | Italy | 254/132 |

*Primary Examiner*—Katherine Matecki

[57] ABSTRACT

A puling device including a leverage mechanism to provide pull and lift by manipulation of a chain, and a force application mechanism to provide the leverage. The force application mechanism provides a variable torque that is at a maximum when the leverage mechanism is in a position to remove ground embedded structures, including posts. The torque diminishes as the leverage mechanism rotates and the structure is lifted. As the structure is lifted the configuration of the chain increases the rate of lift and also provides sufficient lift to remove structures deeply embedded in the ground.

13 Claims, 3 Drawing Sheets

PULLING DEVICE FOR REMOVING GROUND EMBEDDED STRUCTURES

BACKGROUND OF THE INVENTION

1. Field of the Invention

The invention relates to a pulling device for the removal of ground embedded structures and, more particularly, to an improved pulling device that provides maximum lifting force at the start of the pull and maximum height near the end of the pull, the force and lift being provided by a hydraulically actuated piston and an eccentrically pivoted wheel.

2. Description of the Prior Art

A variety of pulling devices have been developed which provide a force to remove tree stumps and the like. Typically these devices utilize a pulley or similar system. Such devices are often driven by hydraulic or electrical motors, combustion engines, or extendible hydraulic cylinders.

One such prior art pulling device utilizes an arrangement of cables which rotate a pulley that has an eccentrically mounted arm. The arm attaches to a chain which is attached to the stump. As the pulley is rotated and lifted the structure is pulled. The device is self-contained and the cable is pulled by a horse, tractor or other moving vehicle.

Another such prior art device utilizes the power from a rod extending from a hydraulic cylinder to provide the lifting force to remove a stump. The device has a ground engaging bifurcated platform which supports a pivoted boom. A cable is wrapped through the boom over a pulley and down toward the ground. The cable is attached to the stump and the hydraulic cylinder assembly provides retraction of the cable along the boom to pull the stump.

Such prior art devices, however, are not generally applicable to the removal of all ground embedded structures, particularly posts or other structures of significant length such as those used to support fencing, road signs and traffic control devices. In particular, the prior devices fail to provide optimum force or lift for the removal of ground embedded structures. For maximum efficiency, a device adaptable for pulling a wide variety of ground embedded structures, including posts, should provide a maximum force when the structure is fully engaged in the ground and its resistance to removal, or yield resistance, is the greatest. The force should decline as the structure yields and is lifted. The lift or height provided to the structure should then be as great as possible so that the structure can be completely disengaged from the ground.

For greater maneuverability the apparatus should also be compact and relatively lightweight. Ideally, it should be operable in relation to a tractor without transmitting the pulling force to the tractor.

The pulling device of this invention provides maximum pull when a ground embedded structure's yield resistance is the greatest and maximum lift to fully remove such structures, particularly long posts, from the ground. The invention utilizes the eccentric rotation of a particularly configured structure to apply pulling force with a pull chain and a varying rotational torque means.

OBJECTS OF THE INVENTION

Accordingly, it is an object of this invention to provide an improved pulling device, and particularly to provide a pulling device which meets the aforementioned needs.

It is a specific object of this invention to provide a pulling device that gives maximum pull when there is maximum yield resistance and maximum lift for disengagement of a post or other ground embedded structure from the ground.

It is a further object of this invention to provide a pulling device that is compact and relatively lightweight for greater maneuverability and transportability.

It is another object of this invention to provide a pulling device that is operable by the auxiliary hydraulic supply of a tractor.

It is yet another object of this invention to provide a pulling device that will not transmit pulling forces to a tractor or the like.

Other objects, advantages and features of the invention will become apparent upon reading the following detailed description and appended claims, and upon reference to the accompanying drawings.

SUMMARY OF THE INVENTION

In accordance with one embodiment of this invention, a pulling device that achieves the foregoing objects includes a ground engaging support structure and a leverage means mounted thereon and rotatable about a pivot point between pull and lift positions. A force application means provides a directional force to the leverage means at a point distant from the pivot point. The perpendicular distance between the direction of force application and the pivot point varies with rotation of the leverage means to provide a variable torque to the leverage means. The torque is at a maximum when the leverage means is in a position to pull a ground embedded structure such as a post and diminishes as the leverage means rotates to its lift position. Load bearing means attached to the leverage means carries the load of the pulled object.

The load bearing means may be flexible and the leverage means configured such that as it rotates between pull and lift positions, the load bearing means attached thereto conforms to the shape of a compound curve. An initial conformed section of the flexible load bearing means, preferably a chain, has a relatively smaller radius of curvature than a later conformed section. The leverage means is preferably an eccentrically pivoted drive wheel having a curved section with a circumference partially formed by a compound curve. The curved section preferably has a grooved rim for maintaining the chain in position during rotation.

The leverage means may alternatively include a boom member extending from the support structure. The boom member may be a detachable accessory that fits over an existing eccentrically pivoted drive wheel to provide greater lift for extra deeply embedded ground structures.

The force application means for either of these embodiments may be a hydraulic cylinder attached to the eccentrically pivoted drive wheel at a distance from the pivot point. The torque is variable because as the cylinder extends and the curved section rotates, the perpendicular distance between the direction of the force and the pivot point decreases. The torque and leverage of the curved section is therefore at a maximum at the start of the pull and diminishes as the post or other ground embedded structure is lifted.

BRIEF DESCRIPTION OF THE DRAWINGS

For a more complete understanding of this invention, reference should now be made to the embodiment illustrated in greater detail in the accompanying drawings and described below by way of example only. In the drawings.

DETAILED DESCRIPTION OF THE DRAWINGS

Figure 1:
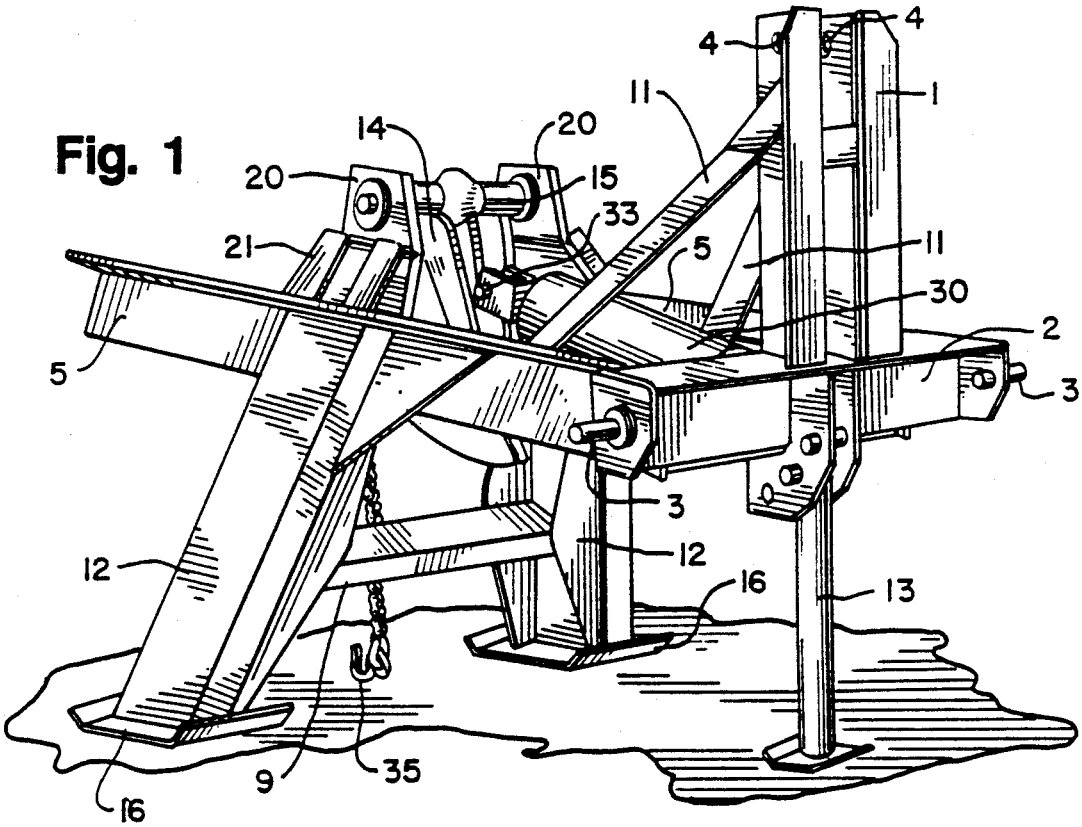
FIG. 1 is a perspective view from the front of a post pulling unit of this invention in a "pull" position.
Figure 2:
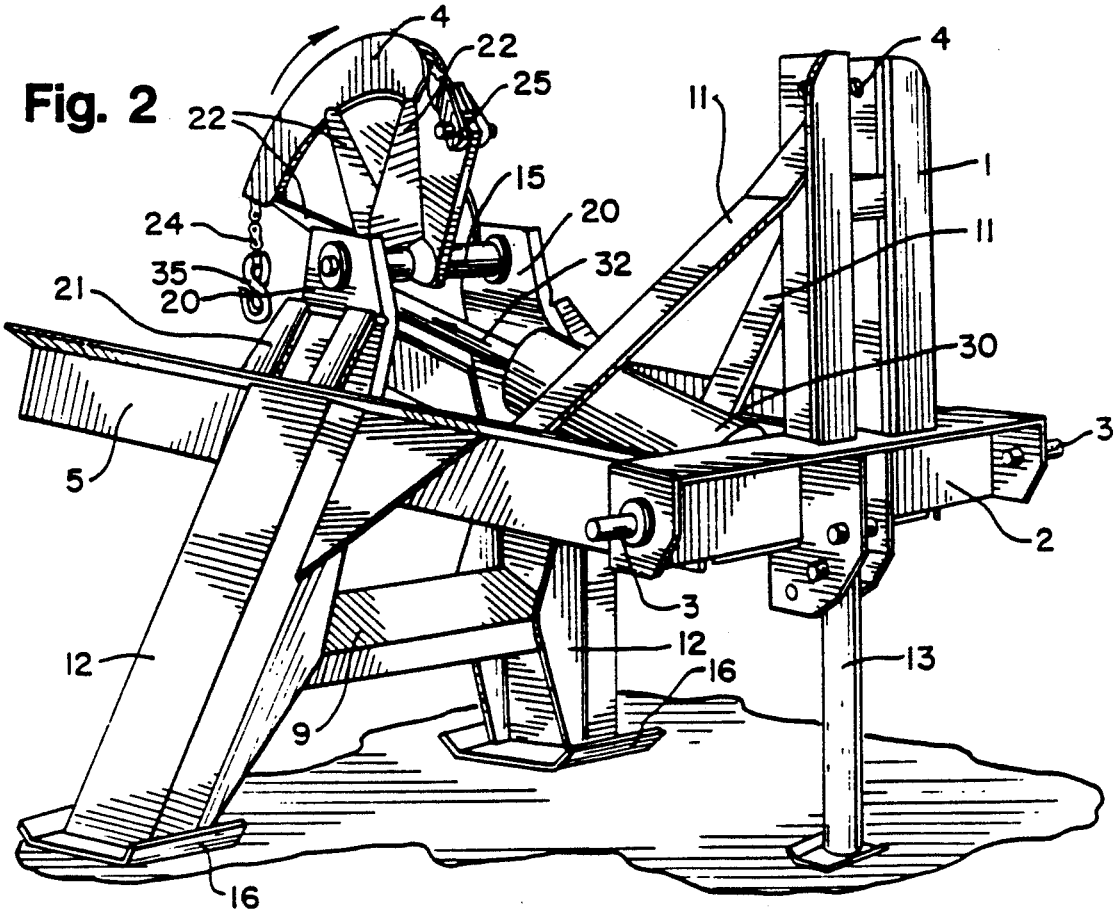
FIG. 2 is a similar front perspective view of the post puller of FIG. 1 in a "full lift" position.

Turning first to FIGS. 1–5, there is shown a pulling unit that can be attached to a tractor or other powered device. The vertical post 1 is attached to the horizontal bar 2. The pins 3 on the horizontal bar 2, and the holes 4 in the vertical post 1 allows for attachment to a 3-point hitch on a tractor (not shown).

Two center members 5 extend from the horizontal bar 2 far enough to restrict the horizontal movement of a post 10 (shown in FIGS. 3 and 4) during the pulling operation. The center members 5 also act as a guide means when initially placing the unit. Stabilizer bars 11, in addition, give rigidity to the framework.

The center members 5 are held in a horizontal position by support members 12. These support members act with leg 13 to maintain the unit in position during its operation. The leg 13 that is movable between a position of ground engagement and retraction to prevent transmission of the pulling forces to the tractor. Leg 13 is also used for stabilizing the device when utilized in its free standing position and can be pivoted out of the way when the device is attached to the 3-point hitch of a tractor which will then provide the rear support for the device. For additional strength, the support members 12 are strengthened by strut 9 and have feet 16 for secure ground engagement.

A drive wheel 14 is pivoted about a pin 15 and is supported by the uprights 20. The uprights 20 are additionally strengthened by the struts 21. The drive wheel 14 has struts 22 to provide extra strength and guide flanges 23 that provide a retention track for a high strength leaf pull chain 24 that is attached to the drive wheel 14 by clevis pin 25. The pull chain 24 could be replaced by an aircraft-type stranded cable or the like.

A hydraulic cylinder 30 is pivotally attached by a pin 31 to the horizontal bar 2. As the preferred force application means, the cylinder preferably is powered by the auxiliary hydraulic supply of a tractor, although other hydraulic sources may also be used. Similarly, other force means may be used such as pneumatic, electrical or mechanical drive apparatus. A cylinder rod 32 extending from the hydraulic cylinder 30 is connected to the drive wheel 14 by a pin 33. A flange 34 may be included to tie the center frame members together and strengthen the unit. It is located conveniently under the cylinder.

The pull chain 24 ends in a hook 35. A gripping chain 40 is wound once or twice around the post or other structure 10. The end of the chain 40 is passed through a slip loop and attached to the hook 35.

Figure 3:
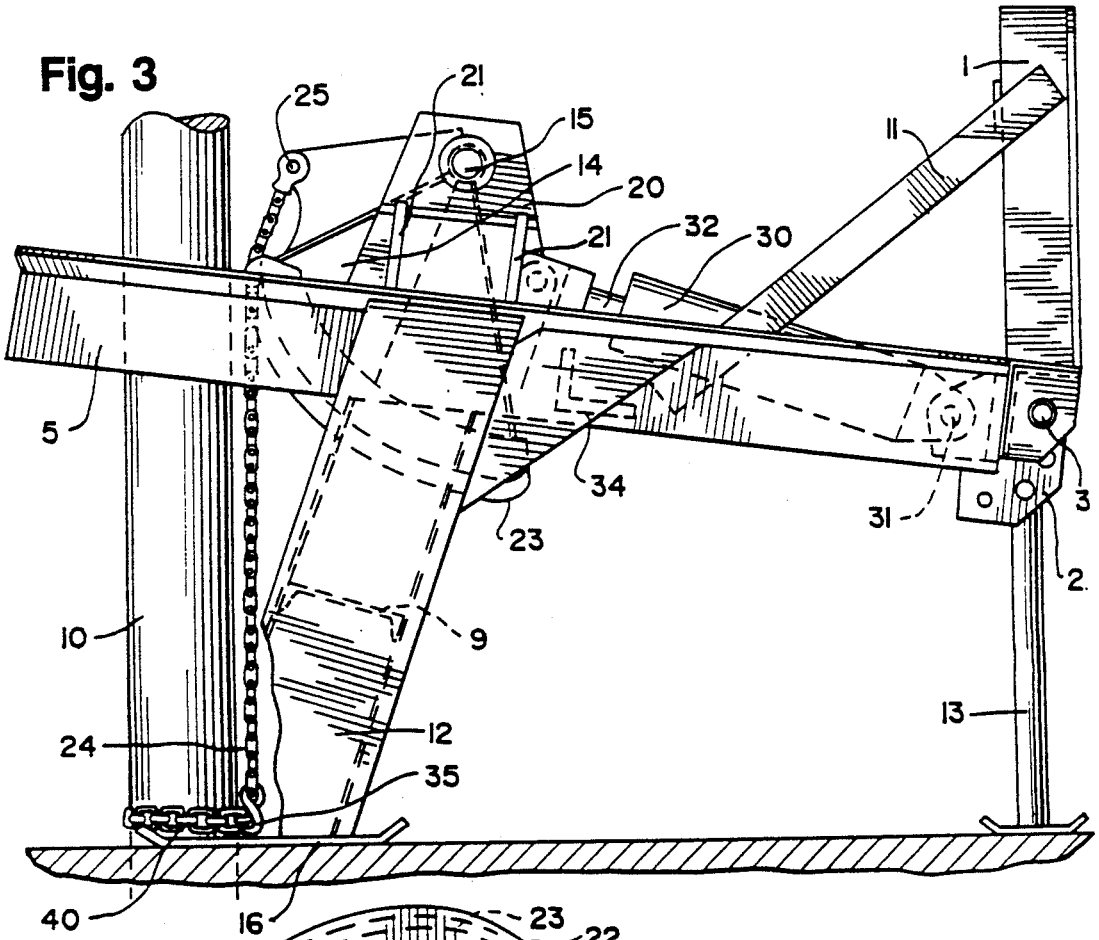
FIG. 3 is a side elevation of the post pulling unit of FIG. 1 in a "pull" position.
Figure 4:
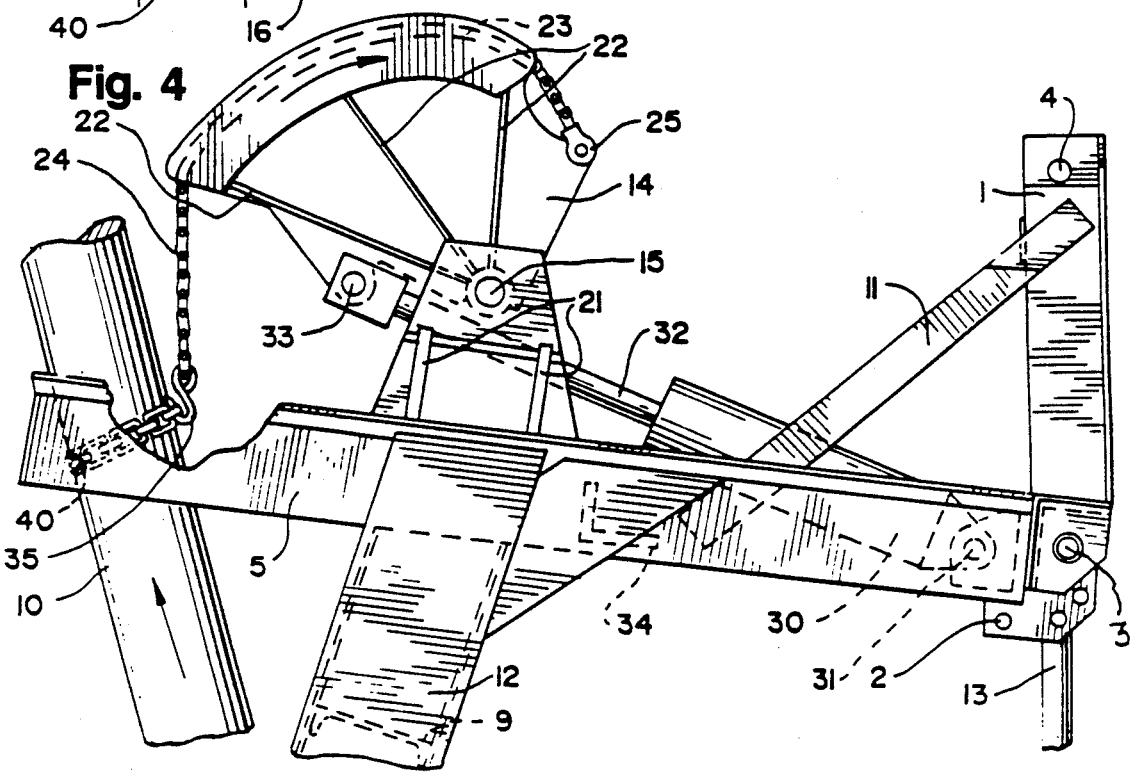
FIG. 4 is a side elevation of the post pulling unit of FIG. 1 in a "full lift" position.

In the pulling operation, most clearly visualized by reference to FIGS. 3 and 4, the vertical post 1 and the horizontal bar 2 are first attached to the 3-point hitch of a tractor. Alternatively, the leg 13 may be engaged with the ground for stability when a power source other than the auxiliary hydraulic supply of a tractor is to be utilized. Using the center members 5, the unit is lined up with the post 10 and the tractor is backed into the correct position. The unit is then lowered to rest on its support members 12 and the drive wheel 14 retracted until it is in its ready position.

In pulling, the drive wheel 14 is rotated to raise the pull chain 24. This engages the hook 35 with the loop chain 40 to tighten the chain around the post 10. When the loop chain 40 is tight, further rotation of the drive wheel 14 exerts an upward pulling force on the post 10 through pull chain 24, hook 35 and loop chain 40 to remove the post from engagement with the ground.

To rotate the drive wheel 14, the hydraulic cylinder 30 may be connected to the previously mentioned auxiliary hydraulic supply ports on the tractor. When the hydraulic supply is activated, hydraulic pressure is introduced into the cylinder 30 extending the cylinder rod 32 and applying a torque to the drive wheel 14 causing the drive wheel to rotate.

The drive wheel 14 is designed so that its circumference is partially formed by a compound curve. Its pivot pin 15, in addition, is located substantially off center to generate maximum pull leverage at the point of maximum yield resistance of the post 10. Consequently, as the drive wheel 14 rotates, the torque applied by the hydraulic cylinder 30 diminishes as the perpendicular distance between the applied force and the pivot pin 15 reduces. Thus, the applied torque is maximized at the beginning of the pulling process so that the greatest force may be applied against the post or the structure while it is fully engaged with the ground.

As the drive wheel 14 is rotated, the yield resistance of the post 10 rapidly decreases and the geometry of the drive wheel 14 progressively increases the rate of lift. This continues as the drive wheel 14 rotates so that the vertical part of the chain 24 is moved further from the pivot 15 as the radius of the drive wheel 14 increases. Consequently, the compound geometry of the drive wheel has the additional benefit of forcing the post away from the unit's operator during the final stages of the pull, causing the post to fall away from both the unit and the operator.

The unit generates leverage and lifting force powerful enough to pull ground embedded structures of many types and under very different conditions, including posts set in hard ground or anchored with concrete. The unit is also compact and lightweight, enabling the unit to be easily maneuvered and transported by any size tractor or transported to a distant site on a small trailer or a pickup truck. The absence of obstruction to upwards motion of a pulled structure means that both deeply embedded structures and those of significant height can be removed by the device. The configuration of the drive wheel serves to push these and all other structures safely away from the unit and operator.

Figure 7:
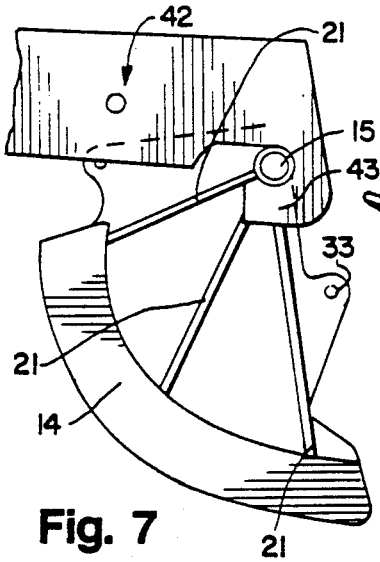
FIG. 7 is a partial view of the boom of FIG. 6 showing its attachment to the drive wheel.
Figure 5:
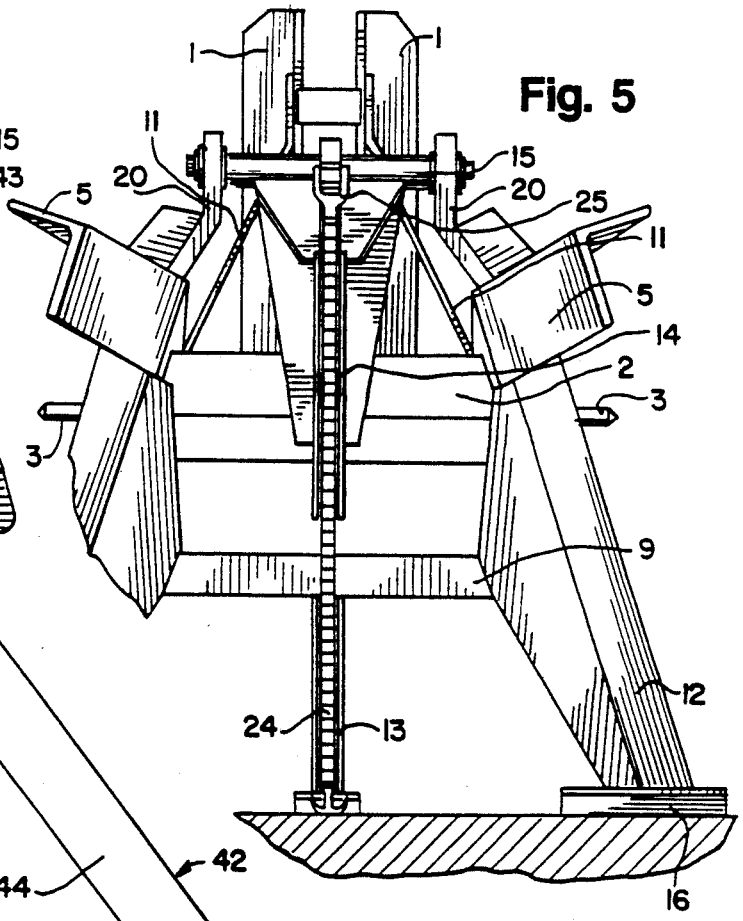
FIG. 5 is a rear elevation of the post pulling unit of FIG. 1.
Figure 6:
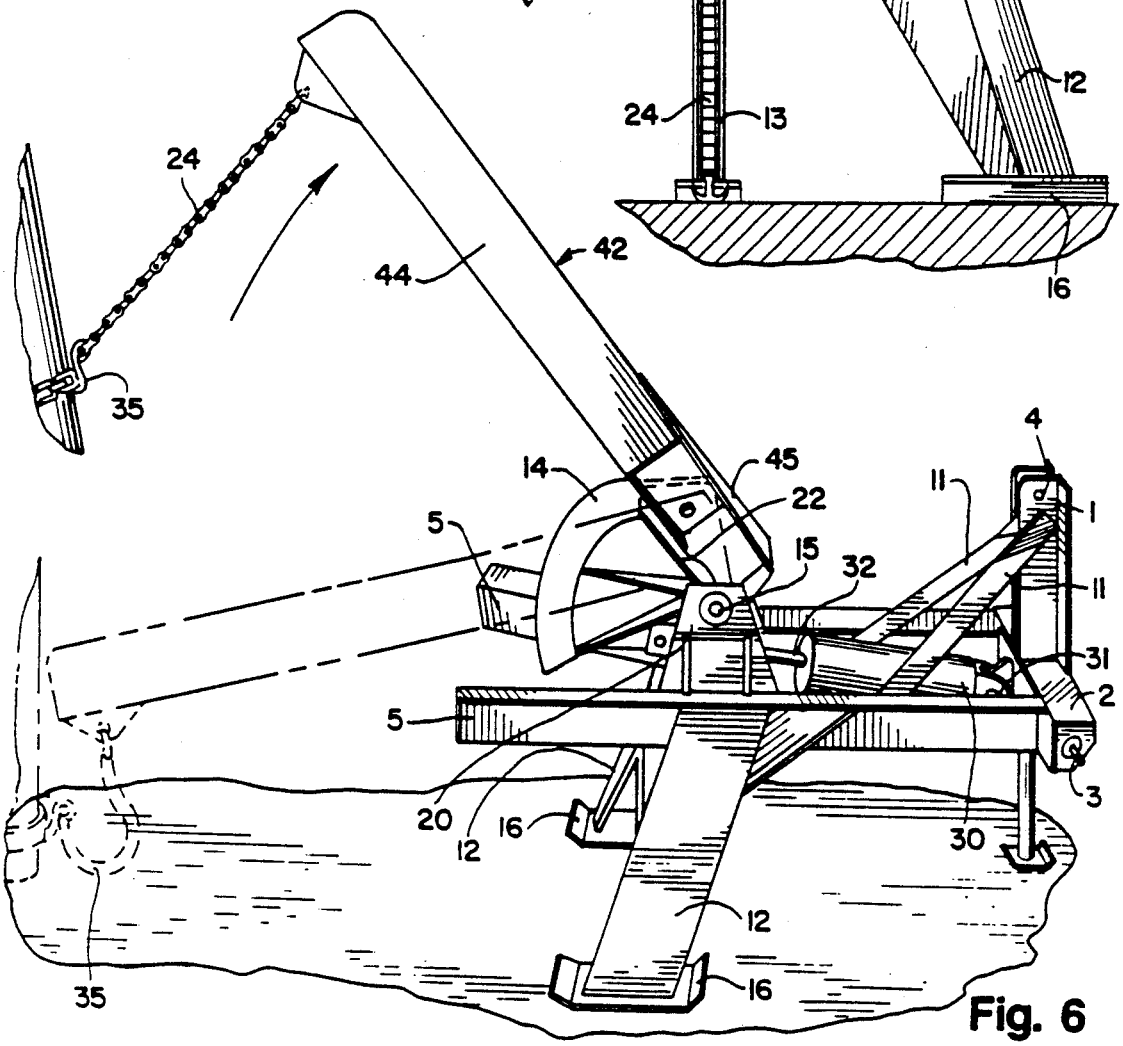
FIG. 6 is a perspective view of an alternative embodiment of the post puller of this invention showing the pulling boom in a "full lift" position, the pull position being shown in broken lines.

A further embodiment of the invention adapted for operation with the unit described above can be seen in FIGS. 6 and 7. This embodiment is similar to that depicted in FIGS. 1–5 and includes an additional extended boom member 42 that attaches over the wheel 14 (see FIG. 7). The boom arm 44 extends to the rear of the unit (i.e., away from any attached tractor or other power source). The end of the boom member 42 nearest the pivot 15 has a box structure 45 that rests on the drive wheel 14 and pivot 15 for stability. This configuration provides an abutment to allow the coordinated movement of the boom member 42 and the drive wheel 14. Parallel hooks 43 are provided to engage the pivot 15 and to secure the boom member to the device during the lifting procedure. Thus, the boom member 42 may move freely between "pull" and "lift" positions with rotation of the drive wheel 14.

The boom arm has a chain attachment 50 at one end for securement of a chain 51. A loop chain arrangement similar to that described for FIGS. 1–5 is attached to the chain 51 for engagement with the post 52 or other embedded structures to be pulled. This arrangement provides maximum pull when the post is fixed in the ground as the hydraulic cylinder acts in the same way as previously described to provide a torque to the drive wheel 14 and to the boom member 42 that diminishes as the post is pulled from the ground.

The extended boom arm 44 enables greater lift to be achieved when the arm is in its "full lift" position than possible with simply the drive wheel 14. An attachment of this sort would therefore be useful for exacting posts that are very deeply embedded in the ground. Larger circumference wheels may also be utilized to give greater lift if required. Other aspects of the invention such as the power source, size and shape of the support members and the like may also be customized for particular applications.

From the foregoing, it will be seen that the invention disclosed provides an easily maneuverable and transportable device that will effectively remove a post in an efficient, non-destructive, safe and labor saving manner. It should be apparent that the objects of the invention have been achieved.

While only two embodiments have been set forth, alternative embodiments and various modifications will be apparent from the above description to those skilled in the art. These and other alternatives are considered equivalents and within the spirit and scope of the present invention.

What is claimed is:

1. A pulling device suitable for the removal of ground embedded structures comprising:

a ground engaging support structure;

leverage means mounted on said ground engaging support structure and rotatable about a pivot point between pull and lift positions;

flexible load bearing means attached to said leverage means and configured such that as said leverage means is rotated between said pull and said lift positions, said flexible load bearing means is progressively wrapped onto the leverage means and conformed to the shape of a curve, an initially conformed section having a relatively smaller radius of curvature than a later conformed section; and force application means for providing a directional force to said leverage means at a point distant from said pivot point.

2. The pulling device of claim 1 wherein said leverage means is an eccentrically pivoted curved section having a circumference partially formed by a compound curve.

3. The pulling device of claim 2 wherein said curved section includes a pair of guide flanges for retention of said flexible load bearing means.

4. The pulling device of claim 1 wherein said force application means is a hydraulic cylinder, said hydraulic cylinder is rotatably coupled to said leverage means at one end and constrained to said support structure at the other end, so that as said hydraulic cylinder is extended said perpendicular distance between said variable axis and said pivot point is reduced.

5. The pulling device of claim 4 wherein said hydraulic cylinder is provided with connection means adapted to engage corresponding connection means of an auxiliary hydraulic power supply of said tractor to power said hydraulic cylinder.

6. The pulling device of claim 5 wherein said support structure additionally comprises two horizontal beams extending beyond the leverage means, mounted so as to restrict horizontal movement of a ground embedded structure during pulling.

7. The pulling device of claim 1 wherein said support structure is provided with a linkage means adapted for cooperative engagement with a corresponding three point hitch of a tractor coupling said device to said tractor.

8. A pulling device suitable for the removal of ground embedded structures comprising:

a ground engaging support structure;

an eccentrically pivoted curved section attached to said ground embedded support structure rotatable about a pivot point between pull and lift positions having a circumference partially formed by a compound curve;

a force application means operatively coupled to said curved section to rotate said curved section about said pivot point when said force application means is actuated, said rotation of said curved section providing a variable torque, said variable torque being at a maximum when said curved section is in said pull position and diminishing as said curved section is rotated to said lift position; and a flexible load bearing means attached to said curved section in such a manner that as said curved section is rotated between said pull and said lift positions said flexible load bearing means is progressively conformed to said compound curve, an initial conformed section having a relatively smaller radius of curvature than a later conformed section.

9. A pulling device as claimed in claim 8 wherein said force application means ia a hydraulic cylinder having an axis disposed a perpendicular distance from said pivot point, said hydraulic cylinder rotatably attached at one end to said curved section at a point distant from said pivot point and rotatably constrained at the other end so that as said hydraulic cylinder is extended, said curved section is rotated and said perpendicular distance between said axis of said cylinder and said pivot point is reduced.

10. A pulling device as claimed in claim 8 wherein said support structure includes two horizontal beams extending beyond the curved section and mounted so as to restrict horizontal movement of a ground embedded structure during pulling.

11. A pulling device as claimed in claim 8 wherein said flexible load bearing means ia a high strength leaf chain.

12. A pulling device as claimed in claim 8 wherein said flexible load bearing means is stranded cable.

13. A pulling device as claimed in claim 8 wherein said eccentrically pivoted curved section includes a pair of guide flanges for retention of said flexible load bearing means.

* * * * *